United States Patent [19]

Nederveld

[11] Patent Number: 4,884,741

[45] Date of Patent: Dec. 5, 1989

[54] SHIPPING CONTAINER AND BLANK THEREFOR

[75] Inventor: Terrill L. Nederveld, Ada, Mich.

[73] Assignee: Packaging Corporation of America, Evanston, Ill.

[21] Appl. No.: 181,660

[22] Filed: Apr. 14, 1988

[51] Int. Cl.[4] ..... B65O 5/10

[52] U.S. Cl. ..... 229/157; 229/185

[58] Field of Search ..... 229/155–158, 229/185

[56] References Cited

U.S. PATENT DOCUMENTS

| | | | |
|---|---|---|---|
| 490,167 | 1/1893 | Schmidt | 229/157 |
| 2,151,733 | 3/1939 | Bonfield | 229/156 |
| 2,361,603 | 10/1944 | Cohen et al. | 229/157 |
| 2,663,491 | 12/1953 | Hill et al. | 229/157 |
| 4,279,377 | 7/1981 | Peeples et al. | 229/157 |
| 4,291,827 | 9/1981 | Mulroy | 229/156 |
| 4,367,840 | 1/1983 | McFadden | 229/157 |
| 4,583,678 | 4/1986 | Weimer, Jr. | 229/185 |
| 4,650,112 | 3/1987 | Booth | 229/157 |
| 4,702,408 | 10/1987 | Powlenko | 229/157 |

FOREIGN PATENT DOCUMENTS

| | | | |
|---|---|---|---|
| 218420 | 11/1961 | Austria . | |
| 452442 | 5/1950 | Italy | 229/157 |

*Primary Examiner*—Gary Elkins

*Attorney, Agent, or Firm*—Neuman, Williams, Anderson & Olson

[57] ABSTRACT

A shipping container and blank therefor are provided wherein the container is particularly suitable for accommodating a wide variety of produce. The container includes a pair of opposed upright side panels and a pair of opposed upright end panels, said pairs being interconnected by first foldlines. Major closure flaps are connected by second foldlines to the side panels and extend therefrom towards one another in a closing mode. Minor closure flaps are connected by third foldlines to the end panels and extend therefrom towards one another in a closing mode and at least partially overlap exterior surfaces of the major closure flaps. Each major closure flap is provided with a pair of relatively spaced locking slots. Each slot is provided with an elongated first segment spaced from an adjacent end panel and extending from a second foldline at an acute angle away from the adjacent end panel, and a second segment obliquely disposed relative to said first segment and spaced a predetermined distance from the second foldline. Each minor closure flap has a peripheral segment thereof opposite a third foldline provided with a pair of notches which define said peripheral segment into a pair of outer tabs. When the major and minor closure flaps are in a closing mode, the outer tabs are inserted through corresponding slots in the major closure flap and effect interlocking of the minor closure flaps thereto.

9 Claims, 2 Drawing Sheets

FIG. 1
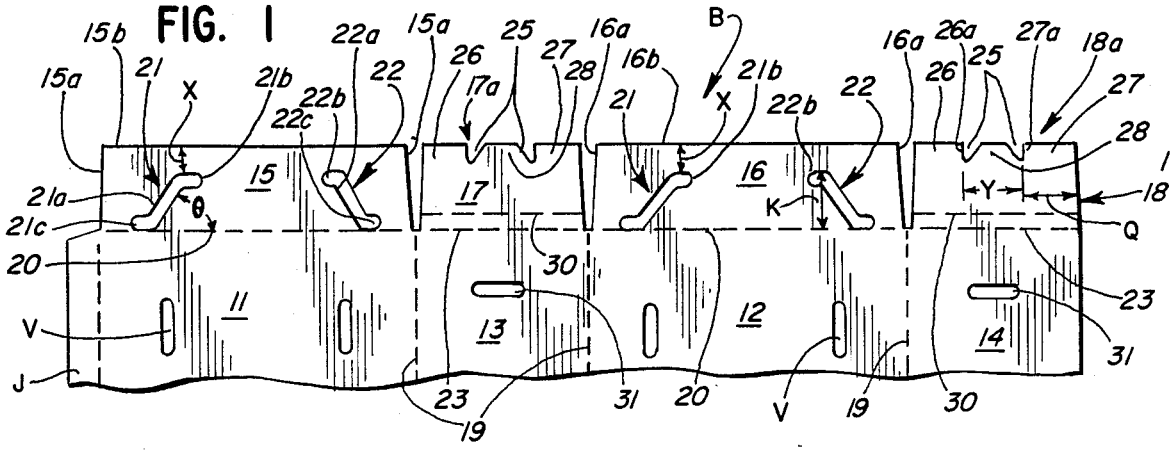
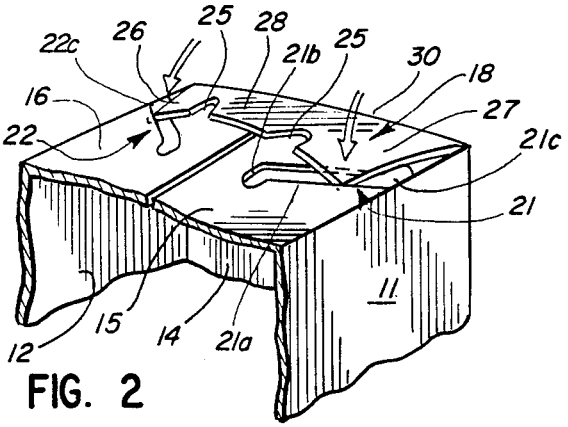
FIG. 2
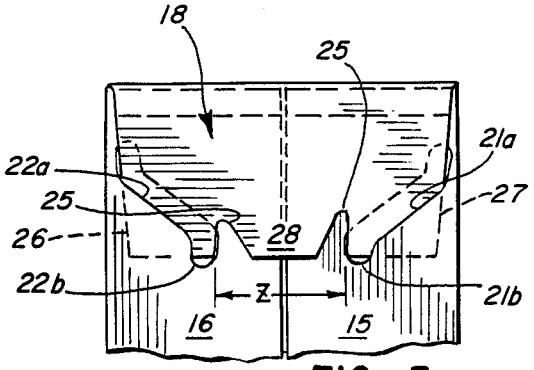
FIG. 3
FIG. 4
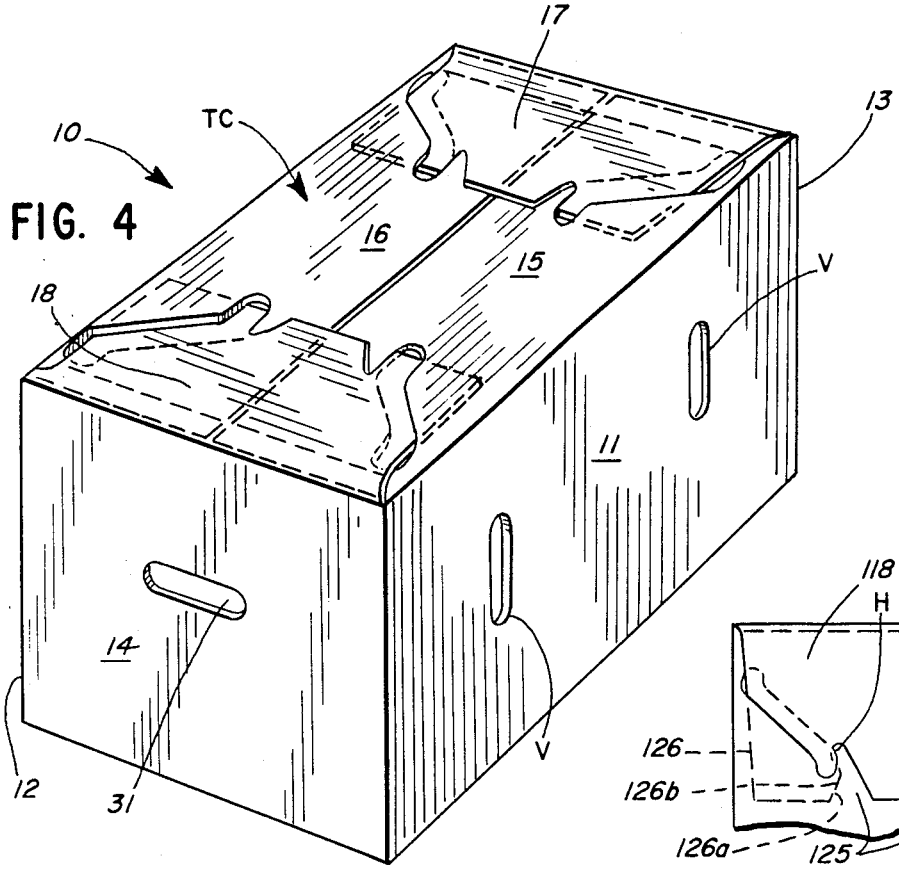
FIG. 5
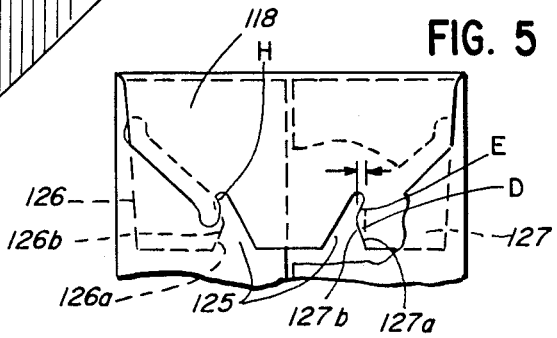

FIG. 6
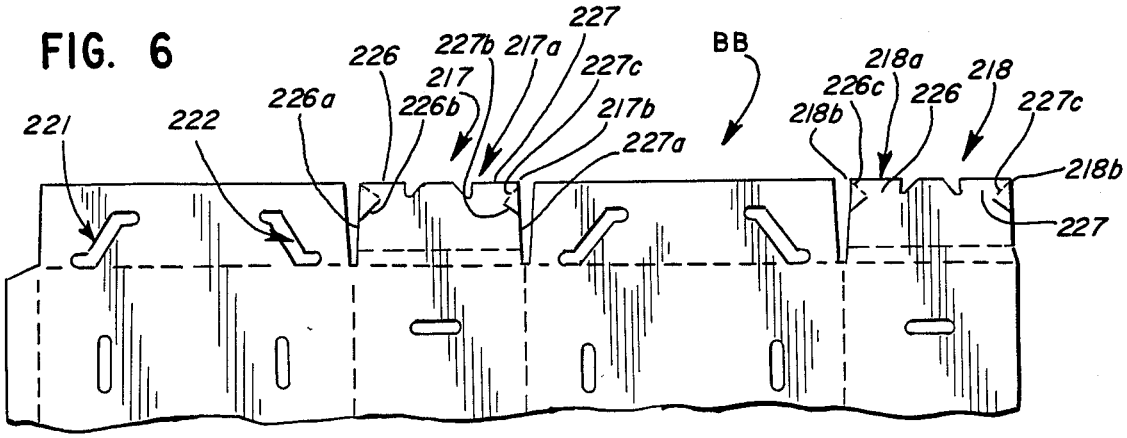
FIG. 7
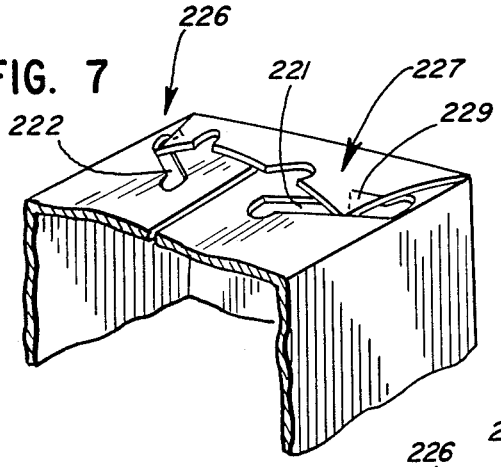
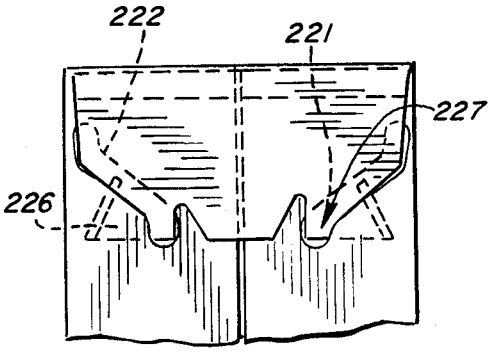
FIG. 8
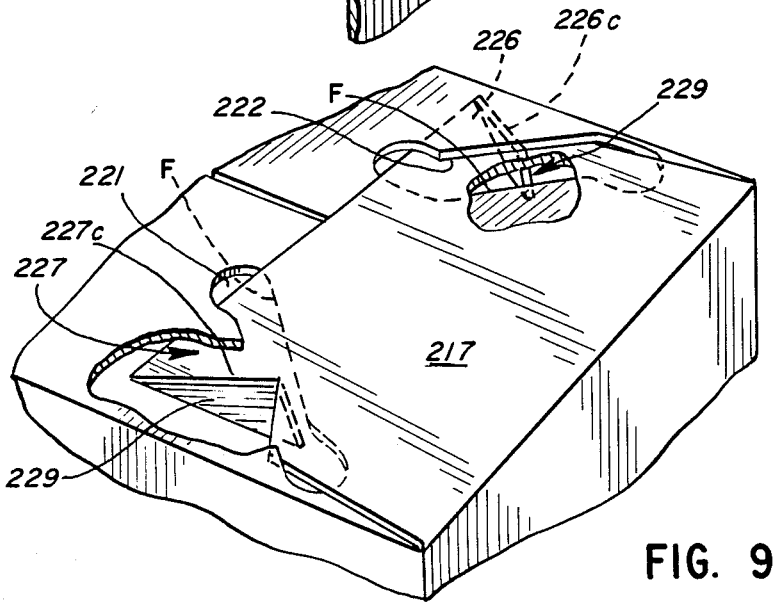
FIG. 9

SHIPPING CONTAINER AND BLANK THEREFOR

BACKGROUND OF THE INVENTION

Various shipping containers, particularly suitable for accommodating produce, have heretofore been available; however, because of certain design characteristics, they have been beset with one or more of the following shortcomings: (a) they were of complex and costly construction; (b) setting up the container was an awkward, time consuming operation requiring manual dexterity, physical strength and sometimes a variety of tools and/or fixtures; (c) the container included numerous components, thus causing inventory problems and in many instances making setup of the container in the field a logistic problem in providing the necessary components; and (d) the container could not be readily collapsed for reuse or compact storage. Frequently, prior shipping containers of this general type could not readily accommodate a variety of produce, and/or provide adequate protection therefor during shipment or storage.

SUMMARY OF THE INVENTION

Thus, it is an object of this invention to provide an improved shipping container which avoids all of the aforementioned shortcomings.

It is a further object to provide an improved shipping container which may be readily collapsed for storage and bulk shipping to the customer and then, may be readily set up in the field in a facile and expeditious manner with a minimum amount of manual effort.

It is a still further object to provide an improved shipping container which does not require special tools and fixtures for setting up or collapsing the container.

It is a still further object to provide an improved shipping container which is formed from a single blank of simple configuration and wherein there is a minimal amount of wasted material.

Further and additional objects will appear from the description, accompanying drawing and appended claims.

In accordance with one embodiment of the invention, an improved shipping container is provided which includes a pair of upright opposed side panels, and a pair of upright opposed end panels connected thereto by first foldlines. Major closure flaps are connected to peripheral segments of the side panels by second foldlines and extend angularly therefrom towards one another in a closing mode. Minor closure flaps are connected to peripheral segments of the end panels by third foldlines and extend angularly therefrom towards one another in a closing mode whereby the minor closure flaps at least partially overlie exterior surfaces of the major closure flaps. Each major closure flap is provided with a pair of relatively spaced locking slots, each of which is spaced a predetermined distance from an adjacent end panel. Each slot includes an elongated first segment which extends at an acute angle from a second foldline and away from the adjacent end panel. Communicating with a distal end of the first segment and extending obliquely therefrom is a second segment. Each minor closure flap has a peripheral segment thereof opposite the third foldline provided with a pair of laterally spaced notches. When the closure flaps are in a closing mode, the outer tabs of each minor closure flap are inserted through corresponding locking slots of the major closure flaps thereby effecting interlocking of the flaps and defining a closure for the container.

DESCRIPTION

For a more complete understanding of the invention, reference is made to the drawing wherein:

FIG. 1 is a fragmentary top plan view of a blank for the improved shipping container and showing a peripheral portion thereof which includes the major and minor closure flaps.

FIG. 2 is a fragmentary perspective view showing the outer tabs of one minor closure flap being partially inserted into corresponding locking slots of the major closure flaps.

FIG. 3 is a fragmentary top plan view showing the minor closure flap of FIG. 2 fully inserted into the locking slots and in interlocking relation therewith.

FIG. 4 is a perspective end view of the improved shipping container fully set up from the blank of FIG. 1.

FIG. 5 is an enlarged fragmentary top plan view showing a first modified minor closure flap in interlocking engagement with the major closure flaps; a portion of one of the major closure flaps being removed so as to reveal more clearly the shape of one peripheral segment of one of the outer tabs of the minor closure flap.

FIG. 6 is similar to FIG. 1 but showing a second modified minor closure flap.

FIG. 7 is a fragmentary perspective view of the second modified minor closure flap showing the outer tabs thereof partially inserted into corresponding locking slots.

FIG. 8 is similar to FIG. 3 showing the second modified minor closure flap in interlocking engagement with the major closure flaps.

FIG. 9 is an enlarged fragmentary perspective top view of the container of FIG. 8 showing the locking tongues formed in the outer tabs folded into locked positions relative to the corresponding slots formed in the major closure flaps.

Referring now to the drawings and more particularly to FIG. 4, one embodiment of the improved shipping container 10 is shown. The container is particularly suitable for accommodating fresh produce (e.g., cabbages, melons, etc.) and may be readily set up manually, loaded and closed in the field near the crop when it is being harvested.

Container 10 preferably has a rectangular configuration and includes a pair of opposed upright side panels 11,12 and a pair of opposed upright end panels 13,14 foldably connected thereto. A pair of major closure flaps 15,16 are shown, respectively, as foldably connected to the upper edges of the side panels 11,12. In a similar manner, a pair of minor closure flaps 17,18 are foldably connected to the upper edges of end panels 13 and 14, respectively. It should be noted, however, that while the closure flaps to be described hereinafter are shown as forming a top closure TC, the invention is not intended to be limited thereto, as such closure flaps may be provided at both the top and bottom edges of the side and end panels, or only on the top edges thereof or only on the bottom edges thereof. For convenience and to facilitate understanding of the improved container, only the major and minor closure flaps will be described hereinafter which form a top closure. The same closure flaps and the method of folding same to a closing mode would apply with respect to forming a bottom closure.

Container 10 is formed from a blank B, FIG. 1, of single wall corrugated fibreboard which has preferably been rendered moisture-resistant by cascading a suitable coating on both faces of the blank. As seen in FIG. 1, the side panels 11 and 12 are alternately arranged in side by side relation with end panels 13 and 14. Adjacent side edges of the panels are connected by parallel first foldlines 19. To one of the panels, either side panel 11 or end panel 14 is foldably connected a joint flap J of conventional design. Flap J is adapted to foldably interconnect panels 11 and 14.

Connected by second foldlines 20 to the upper edges of side panels 11,12 are the major closure flaps 15,16. Each foldline 20 spans the distance between the joint flap J and end panel 13 in the case of side panel 11, or between the end panels 13,14 in the case of side panel 12. The foldlines 20 are in endwise alignment and are at right angles to foldlines 19. The major closure flaps are of like configuration and thus, only flap 15 will be hereinafter described. Flap 15,16 is provided with a pair of laterally spaced locking slots 21,22. Each slot is spaced a like distance from an adjacent end edge 15*a*,16*a* of the flap and includes an elongated first segment 21*a*,22*a* having one end thereof terminating at or in close proximity to foldline 20. Each first segment extends from foldline 20 at an acute angle $\theta$ (e.g., 60°–70°) away from the adjacent end edge 15*a*,16*a* of the major closure flap. The outer edge of the first segment is spaced by an amount X from the elongated distal edge 15*b*,16*b* of flap 15,16.

Extending obliquely from the outer end of the first segment and away from the adjacent end edge 15*a*,16*a* is a relatively short second segment 21*b*,22*b*. If desired, the inner end of the first segment may be connected to a relatively short third segment 21*c*,22*c* which extends towards the adjacent end edge. Thus, the second and third segments preferably extend in opposite directions from the first segment.

Connected by third foldlines 23 to the upper edges of end panels 13,14 are minor closure flaps 17,18. The foldlines 23 are substantially coextensive with the upper edges of the end panels. Each minor closure flap 17,18 is of like configuration and has a distal outer edge 17*a*,18*a* provided with a pair of laterally spaced notches 25. By reason of the notches, each outer edge is formed into a pair of outer tabs 26,27 and an intermediate tab 28. The spacing Y between the inner edges 26*a*,27*a* of the outer tabs 26,27 of each minor closure flap 17,18 is substantially the same as the distance Z between the second segments 21*b* or 22*b* of the transversely aligned slots, when the major closure flaps 15,16 are in the closing mode, see FIG. 3. The width dimension Q of each outer tab 26,27 is substantially the same and corresponds substantially to the distance K measured from the outer edge of the slot second segment 21*b*,22*b* to the corresponding foldline 20, see FIG. 1.

Each minor closure flap 17,18 is provided with a fourth foldline 30 which is spaced from and parallel to the adjacent third foldline 23. The function of foldline 30 will be described more fully hereinafter.

When setting up container 10 from blank B, the side panel 11, joint flap J and major closure flap 15 are initially folded as a unit about foldline 19 connecting panels 11 and 13 so as to overlie panels 13,12. End panel 14 and minor closure flap 18 are then folded as a unit about foldline 19 connecting panels 12,14 so as to overlie a portion of panel 12 and the joint flap J, the latter having been previously positioned over panel 12. The joint flap J is then secured to the overlapping portion of end panel 14 by adhesive, staples or stitching whereupon the container is in a collapsed mode wherein it may be readily stored and taken to a designated location in a field where harvesting of a crop is to occur. Once the collapsed container has been placed at the desired location, the side and end panels are squared up relative to one another so that the major and minor closure flaps at either the upper or lower edges of the side and end panels face upwardly. The major closure flaps 15,16 are then manually folded inwardly towards one another so that each flap 15,16 is at a substantial right angle with respect to the corresponding side panel, see FIG. 2. Each minor closure flap 17,18 is then individually folded inwardly about foldline 23 so as to overlie corresponding end portions of the previously folded major flaps 15,16. The outer tabs 26,27 of the minor flap are then inserted into the corresponding slots 21,22 formed in major flaps while the intermediate tab 28 remains in overlying relation with the exterior surfaces of the major flaps.

To facilitate insertion of the outer tabs, the outer portion of the minor flap is folded downwardly slightly about foldline 30, and simultaneously therewith, the outer corners of the outer tabs are manually distorted downwardly and pushed into the corresponding slots at the third segments 21*c*,22*c* thereof. Because of the angular disposition of the slot first segments 21*a*,22*a*, the resistance encountered in pushing the outer tabs through the slots is significantly reduced thereby markedly reducing the manual effort required. Once the major and minor closure flaps are in interlocking engagement, the partially set up container is inverted, so as to enable the container to be loaded.

Once the loading is completed, the open top is closed by folding top closure flaps into interlocking relation in the manner as previously described. If no top closure flaps are provided, then the top of the container may be closed by a conventional telescoping cover, not shown.

While the slots 21 and 22 have been described as being formed in the major closure flaps 15, 16, in some instances, it may be desirable to form the slots in the minor closure flaps 17,18 in which case the outer distal edges of the major closure flaps would be provided with the previously described notches 25. In this latter configuration, the minor closure flaps would be initially folded towards one another and then the major closure flaps folded so as to overlie the minor closure flaps. The overlying major closure flaps would then be manipulated into interlocking relation with the minor closure flaps in a manner as previously described.

Suitable hand slots 31 may be provided in the end panels to facilitate lifting either manually or with power equipment, not shown. Vents V may be formed in the side and/or end panels to allow circulation of air within the loaded container.

FIG. 5 discloses a modified minor closure flap 118 wherein the notches 125 formed in the outer edge of the flap cause the inner edge 126*a*,127*a* of each outer tab 126,127 to be provided with a protuberance or nub 126*b*,127*b*. Each protuberance has sloping side edges D and E. Side edge D is the longer of the two and extends from an outer corner of the edge 126*a*,127*a* to approximately two-thirds of the depth of the notch. The slope of the side edges is rather gentle (e.g., approximately 5°) and each protuberance has a projection of approximately ¼". Thus, once the outer tab 126,127 has been inserted through the locking slot to the fullest extent, the portion of the slot adjacent the juncture between the first and second segments thereof forms a heal H which is captured between the base of the notch and the protuberance resulting in a more positive interlocking engagement between the major and minor closure flaps.

FIGS. 6–9 show a second modification of the minor closure flaps 217,218 embodied in the improved container. As seen more clearly in FIG. 6, each minor closure flap 217,218 in the blank BB has the exposed outer side edges 226a,227a of the outer tabs 226,227 formed therein provided with slits 226b,227b which extend angularly towards the outer distal edge 217a,218a of the minor closure flap. The inner end of each slit terminates at a short foldline 226c,227c which extends angular from a respective corner 217b,218b of the flap. The corners 217b,218b are formed at the intersections of the outer distal edge 217a,218a and the outer side edges 226a,227a. The short foldline and the corresponding slit cooperate to form a triangular locking tongue 229. The purpose of each tongue when it is folded downwardly about the short foldline 226c,227c into the container interior after the tabs 226,227 have been inserted through the corresponding slot 221 or 222 in the major closure flaps, is to prevent the minor closure flap from accidently becoming disengaged from the slots. This is accomplished by the edge of tongue formed by the slit being adapted to abut the edge F defining one side of the first segment of the corresponding slot 221,222, see FIGS. 8 and 9. The relative folded positions of the tongues with respect to the remainder of the outer tabs are clearly shown in FIG. 9. Other than the inclusion of the locking tongues 229, blanks BB and B are of like configuration.

The shape and size of the major and minor closure flaps as well as the side and end panels may vary from that shown without departing from the scope of the invention hereinafter claimed.

I claim:

1. A shipping container comprising a pair of opposed upright first panels; a pair of opposed upright second panels angularly disposed relative to said first panels, adjacent first peripheral portions of said first and second panels being interconnected by first foldlines and defining upright corners; first closure flaps connected by second foldlines to corresponding second peripheral portions of said first panels and extending angularly therefrom towards one another in a closing mode; and second closure flaps connected by third foldlines to corresponding second peripheral portions of said second panels and extending angularly therefrom towards one another when in a closing mode whereby said second flaps at least partially overlap exterior surfaces of said first closure flaps and lockingly cooperate therewith to form a closure; each first closure flap being provided with a pair of relatively spaced locking slots, each slot being spaced a first predetermined distance from an adjacent upright corner and including an elongate first segment extending at an acute angle away from an adjacent second panel and a second segment obliquely disposed relative to an end of said first segment and spaced a predetermined distance from one of the second foldlines; the slot second segments formed in each first closure flap extending from the first segments towards one another, each second closure flap having means formed in a peripheral segment thereof opposite the third foldline, said means defining said peripheral segment into a pair of relatively spaced outer tabs, the latter being simultaneously inserted into the corresponding locking slots formed in said first flaps; each outer tab having a peripheral portion thereof disposed within a second segment of the corresponding slot.

2. The shipping container of claim 1 wherein the spacing between inner peripheral portion of the outer tabs of each second closure flap corresponds substantially to the distance between the second segments of corresponding locking slots of the first closure flaps when the latter are in the closing mode.

3. The shipping container of claim 2 wherein the means of each second closure flap includes a pair of laterally spaced notches, each notch defining an inner peripheral edge of an outer tab, a portion of each inner peripheral edge being in slidable interlocking engagement with the inner peripheral portion of a second segment of a corresponding locking slot in a first closure flap when said flaps are in a closing mode.

4. A blank of foldable sheet material for a shipping container comprising a pair of first panels; a pair of second panels, the panels of said pairs being arranged in alternate side-by-side relation and interconnected by parallel first foldlines; a pair of first closure flaps connected by second foldlines to corresponding peripheral segments of said first panels; and a pair of second closure flaps connected by third foldlines to corresponding peripheral segments of said second panels, said second and third foldlines being in substantially aligned relation; each first closure flap being provided with a pair of relatively spaced locking slots, each slot being provided with an elongate first segment spaced from an end edge of the first closure flap and extending at an acute angle away from said end edge and a second segment spaced from a second foldline and extending obliquely from an end of said first segment, the slot first segments of each first closure flap extending convergently from the flap second foldline, said slot second segments extending towards one another; each second closure flap having a distal peripheral edge thereof opposite the third foldline provided with a pair of relatively spaced outer tabs, said outer tabs interlockingly engaging said slot second segments when said blank is set up to form the container and said closure flaps are in a closing mode.

5. A blank of foldable sheet material for a shipping container comprising a pair of first panels; a pair of second panels, the panels of said pairs being arranged in alternate side-by-side relation and interconnected by parallel first foldlines; a pair of first closure flaps connected by second foldlines to corresponding peripheral segments of said first panels; and a pair of second closure flaps connected by third foldlines to corresponding peripheral segments of said second panels, said second and third foldlines being in substantially aligned relation; each first closure flap being provided with a pair of relatively spaced locking slots, each slot being provided with an elongated first segment spaced from an end edge of the first closure flap and extending at an acute angle away from said end edge and a second segment spaced from a second foldline and extending obliquely from an end of said first segment; each second closure flap having a distal peripheral edge thereof opposite the third foldline provided with a pair of relatively spaced outer tabs, said outer tabs interlockingly engaging said slots when said blank is set up to form the container and said closure flaps are in a closing mode; each outer tab of a second closure flap being provided with an outer side edge which cooperates with the distal peripheral edge of the second closure flap to form a corner; a short foldline is provided which extends angularly from the said corner and terminates at one end of a slit spaced from the said corner and extending angularly from the tab outer side edge towards the flap distal peripheral edge; said short foldline and said slit cooperating to form a tongue; when said blank is set up to form the container and the first and second closure flaps are in the closing mode, said tongues being folded into the container interior whereby a peripheral edge of each tongue abuttingly engages a peripheral portion of the first segment of a corresponding slot.

6. The blank of claim 5 wherein each tongue has a triangular configuration.

7. The blank of claim 4 or 5 wherein the outer tabs of each second closure flap are at least partially defined by a pair of laterally spaced notches formed in the distal peripheral edge of the second closure flap.

8. A shipping container comprising a pair of opposed upright first panels; a pair of opposed upright second panels angularly disposed relative to said first panels, adjacent peripheral portions of said first and second panels being interconnected by first foldlines and defining upright corners; first closure flaps connected by second foldlines to corresponding peripheral segments of said first panels and extending angularly therefrom towards one another when in a closing mode; and second closure flaps connected by third foldlines to corresponding peripheral segments of said second panels and extending angularly therefrom towards one another when in a closing mode whereby said second flaps at least partially overlap exterior surfaces of said first closure flaps and cooperate therewith to form a closure; each first closure flap being provided with a pair of relatively spaced locking slots, each slot being spaced a first predetermined distance from an adjacent upright corner and including an elongated first segment extending at an acute angle away from an adjacent second panel, and a second segment obliquely disposed relative to an end of said first segment and spaced a predetermined distance from the second foldline; each second closure flap having means formed in a peripheral segment thereof opposite the third foldline of said second closure flap, said means defining said peripheral segment into a pair of outer tabs, the latter being simultaneously inserted into corresponding locking slots formed in said first flaps and effecting interlocking of the second flap with said first flaps; each locking slot being provided with a third segment adjacent the second foldline connecting the first closure flap to a first panel, said third segment extending obliquely from an end of the first segment disposed opposite the second segment.

9. A shipping container comprising a pair of opposed upright first panels; a pair of opposed upright second panels angularly disposed relative to said first panels, adjacent first peripheral portions of said first and second panels being interconnected by first foldlines and defining upright corners; first closure flaps connected by second foldlines to corresponding second peripheral portions of said first panels and extending angularly therefrom towards one another in a closing mode; and second closure flaps connected by third foldlines to corresponding second peripheral portions of said second panels and extending angularly therefrom towards one another when in a closing mode whereby said second flaps at least partially overlap exterior surfaces of said first closure flaps and lockingly cooperate therewith to form a closure; each first closure flap having a pair of relatively spaced locking slots, each slot being spaced a first predetermined distance from an adjacent upright corner and including an elongate first segment extending at an acute angle away from an adjacent second panel and a second segment obliquely disposed relative to an end of said first segment and spaced a predetermined distance from one of the second foldlines; each second closure flap having a pair of laterally spaced notches formed in a peripheral segment thereof opposite the third foldline, said notches defining a pair of relatively spaced outer tabs, the distance between each pair of outer tabs corresponds substantially to the distance between the second segments of corresponding locking slots of the first closure flaps when the latter are in the closing mode; each notch defining an inner peripheral edge of an outer tab, a portion of each inner peripheral edge being in slidable interlocking engagement with a second segment of a corresponding locking slot in a first closure flap when in a closing mode, the inner peripheral edges of predetermined outer tabs each being provided with a protuberance.

* * * * *

UNITED STATES PATENT AND TRADEMARK OFFICE

CERTIFICATE OF CORRECTION

PATENT NO. : 4,884,741

DATED : December 5, 1989

INVENTOR(S) : Terrill L. Nederveld

It is certified that error appears in the above-identified patent and that said Letters Patent is hereby corrected as shown below:

Column 6, lines 3-8, claim 2 should read as follows:

The shipping container of claim 1 wherein the spacing between the outer tabs of each second closure flap corresponds substantially to the distance between inner peripheral portions of the second segments of corresponding locking slots of the first closure flaps when the latter are in the closing mode.

Signed and Sealed this

Twenty-fifth Day of December, 1990

*Attest:*

HARRY F. MANBECK, JR.

*Attesting Officer*

*Commissioner of Patents and Trademarks*